US010328714B2

(12) United States Patent
Ogura et al.

(10) Patent No.: US 10,328,714 B2
(45) Date of Patent: Jun. 25, 2019

(54) PRINTING APPARATUS AND PRINTING METHOD

(71) Applicant: SEIKO EPSON CORPORATION, Tokyo (JP)

(72) Inventors: Kiyotaka Ogura, Azumino (JP); Yasuo Naramatsu, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/886,329

(22) Filed: Feb. 1, 2018

(65) Prior Publication Data

US 2018/0222210 A1 Aug. 9, 2018

(30) Foreign Application Priority Data

Feb. 3, 2017 (JP) ..... 2017-018681

(51) Int. Cl.
*B41J 2/32* (2006.01)
*B65H 31/24* (2006.01)
*B65H 7/20* (2006.01)

(52) U.S. Cl.
CPC ..... *B41J 2/32* (2013.01); *B65H 7/20* (2013.01); *B65H 31/24* (2013.01); *B41J 2202/30* (2013.01)

(58) Field of Classification Search
CPC ..... B41J 32/00; B41J 32/02; B41J 2/32; B41J 2202/30; B65H 31/24; B65H 7/20
See application file for complete search history.

(56) References Cited

U.S. PATENT DOCUMENTS

2012/0044313 A1* 2/2012 Yamada ..... B41J 2/32 347/197
2012/0162334 A1 6/2012 Sasaki

FOREIGN PATENT DOCUMENTS

JP 2012-139822 A 7/2012

* cited by examiner

*Primary Examiner* — Kristal Feggins
(74) *Attorney, Agent, or Firm* — Foley & Lardner LLP

(57) ABSTRACT

A printing apparatus includes a printing unit that performs printing on a medium transported in a transport direction, a heating unit located downstream of the printing unit in the transport direction and configured to heat the medium, and a control unit that executes a printing operation including printing an image on the medium according to a printing instruction inputted. The control unit is configured to, when the printing operation on the medium according to an Nth (N=an integer not smaller than 1) printing instruction is finished, and then a standby operation, including waiting for a start of the printing operation on the medium according to an (N+1)th printing instruction, is performed, continue to transport the medium during the standby operation.

14 Claims, 5 Drawing Sheets

PRINTING APPARATUS AND PRINTING METHOD

BACKGROUND

1. Technical Field

The present invention relates to a printing apparatus and a printing method.

2. Related Art

Various types of printing apparatuses have thus far been utilized, some of which include a heating unit for heating a medium.

For example, JP-A-2012-139822 discloses a recording apparatus (printing apparatus) that includes a heater, corresponding to the heating unit.

In some of the conventional printing apparatuses that include the heating unit for heating a medium, however, the transport route of the medium includes a heating range where the heat of the heating unit is applied to the medium, and a non-heating range where the heat of the heating unit is not applied to the medium. Besides, in the heating range of some printing apparatuses, the heat amount applied to the medium differs depending on the position of the medium, in other words the heating range includes a region where a relatively larger amount of heat is applied to the medium, and another region where a relatively smaller amount of heat is applied to the medium. In the printing apparatuses configured as above, when the medium is heated while remaining stopped for a certain period of time, the medium may be unevenly heated depending on the positional relationship between the heating range of the heating unit and the medium, and the shape of the heating range, in particular the shape of the support member of the medium. As result, the color of the image printed on the medium may become uneven, owing to the uneven heating.

SUMMARY

An advantage of some aspects of the invention is provision of a printing apparatus including a heating unit for heating a medium, configured to prevent color unevenness of an image originating from uneven heating of the medium.

In an aspect, the invention provides a printing apparatus including a printing unit that performs printing on a medium transported in a transport direction, a heating unit located downstream of the printing unit in the transport direction and configured to heat the medium, and a control unit that executes a printing operation including printing an image on the medium according to a printing instruction inputted. The control unit is configured to, when the printing operation on the medium according to an Nth (N=an integer not smaller than 1) printing instruction is finished, and then a standby operation including waiting for a start of the printing operation on the medium according to an (N+1)th printing instruction is performed, continue to transport the medium during the standby operation.

In the printing apparatus configured as above, the medium continues to be transported, during the standby operation including waiting for the start of the printing operation on the medium according to the (N+1)th printing instruction, after the printing operation on the medium according to the printing instruction of the Nth time is finished. Such an arrangement prevents the medium from being unevenly heated because of being stopped in the heating range of the heating unit, during the standby for the start of the printing operation on the medium according to the (N+1)th printing instruction, after the printing operation on the medium according to the Nth printing instruction is finished. Therefore, the color unevenness of the image, originating from uneven heating of the medium, can be prevented.

The expression "continue to transport the medium" herein refers to continuing to transport (move) the medium to restrict the medium from staying at the same position longer than a predetermined time, including both continuously transporting the medium and intermittently transporting the medium. Further, continuing to transport the medium in the transport direction (forward transport), continuing to transport the medium in the reverse direction to the transport direction (reverse transport), and repeating the forward transport and the reverse transport, are also included.

In the foregoing printing apparatus, the control unit may continue to transport the medium during the standby operation under a same condition as during the printing operation.

With the mentioned arrangement, the medium continues to be transported such that the medium is transported during the standby operation in a same manner as during the printing operation. Therefore, in the heating range of the heating unit, the medium can be heated in the same manner as during the printing operation, during the standby operation that follows the printing operation. Consequently, the medium can be prevented from being unevenly heated owing to a change in heating condition between the printing operation and the standby operation, and the color unevenness in the image can be effectively suppressed.

The foregoing printing apparatus may further include a support member that supports the medium along a transport route thereof, and the support member may include a bent portion formed in the heating range of the heating unit.

In this case, the support member provided along the transport route of the medium includes the bent portion located in the heating range of the heating unit. Bending the support member, in other words forming the bent portion in the support member, prevents an increase in size of the printing apparatus. Further, forming the bent portion in the support member, instead of bending the support member in an arcuate shape, simplifies the formation process of the support member having the bent shape.

In the foregoing printing apparatus, the control unit may finish the standby operation in a case where the (N+1)th printing instruction has not been inputted within a predetermined time, and perform a remedial operation including transporting the medium until the image printed on the medium is located in a predetermined remedial position.

With the mentioned arrangement, in the case where the (N+1)th printing instruction has not been inputted within the predetermined time, the standby operation is finished and the medium is transported until the image printed on the medium is located in the predetermined remedial position. Accordingly, setting the remedial position in a location where uneven heating is unlikely to take place prevents the medium from being unevenly heated, owing to a prolonged time before the next printing instruction is inputted.

Here, the term "remedial position" herein refers to, for example, a position in the heating range of the heating unit where a whole image is heated under the same condition, and a position where the whole image is located outside the heating range of the heating unit.

In the foregoing printing apparatus, the control unit may perform a maintenance operation including performing a maintenance work for the printing apparatus, after the remedial operation is finished.

In this case, since the maintenance operation is performed after the remedial operation is finished, the medium can be prevented from being unevenly heated because of remaining in the heating range of the heating unit during the maintenance operation. Therefore, the color unevenness in the image, originating from the uneven heating, can be more effectively suppressed.

Here, the term "maintenance operation" herein refers to, for example, correcting uneven distribution of grease on a guide shaft, when the printing unit is configured to reciprocate in a scanning direction intersecting the transport direction, more specifically causing the printing unit to reciprocate over the entire stroke range in the scanning direction, detecting skewed transport of the medium, more specifically transporting the medium in the forward and reverse directions thereby detecting whether the ends of the medium in the width direction are within a predetermined range, and flushing, in other words ejecting a liquid from a nozzle for the purpose of discharging residual liquid, when the printing unit is a liquid ejecting unit.

In the foregoing printing apparatus, the control unit may transport the medium in the transport direction during the standby operation, finish the standby operation when the (N+1)th printing instruction is inputted within the predetermined time, and start the printing operation on the medium according to the (N+1)th printing instruction, after transporting the medium in a reverse direction to the transport direction.

In this case, the medium is transported in the forward direction during the standby operation, and then transported in the reverse direction after the standby operation is finished, before the next printing operation is started. Such an arrangement prevents a portion of the medium transported during the standby operation from being wasted.

In the foregoing printing apparatus, the control unit may transport the medium in the transport direction during the standby operation, finish the standby operation when the (N+1)th printing instruction is inputted within the predetermined time, and start the printing operation on the medium according to the (N+1)th printing instruction, without transporting the medium in the reverse direction to the transport direction.

In this case, the medium is transported in the forward direction during the standby operation, and the next printing operation is started, without the medium being transported in the reverse direction, after the standby operation is finished. Accordingly, a portion of the medium unintendedly heated by the heating unit during the standby operation, in other words a portion of the medium that may have been unevenly heated, can be prevented from being used for the printing. Therefore, the image can be printed without color unevenness, in the next printing operation.

In another aspect, the invention provides a printing method to be performed by a printing apparatus including a printing unit that performs printing on a medium transported in a transport direction, and a heating unit located downstream of the printing unit in the transport direction and configured to heat the medium. The printing method includes, after finishing a printing operation on the medium according to an Nth (N=an integer not smaller than 1) printing instruction, performing a standby operation including waiting for a start of the printing operation on the medium according to an (N+1)th printing instruction, and continuing to transport the medium during the standby operation.

By the method arranged as above, the medium continues to be transported, during the standby operation including waiting for the start of the printing operation on the medium according to the (N+1)th printing instruction, after the printing operation on the medium according to the printing instruction of the Nth time is finished. Such an arrangement prevents the medium from being unevenly heated because of being stopped in the heating range of the heating unit, during the standby for the start of the printing operation on the medium according to the (N+1)th printing instruction, after the printing operation on the medium according to the Nth printing instruction is finished. Therefore, the color unevenness of the image, originating from uneven heating of the medium, can be prevented.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereafter, a printing apparatus according to an embodiment of the invention will be described in detail, with reference to the drawings.

First, the outline of the printing apparatus according to the embodiment of the invention will be described.

Figure 1:
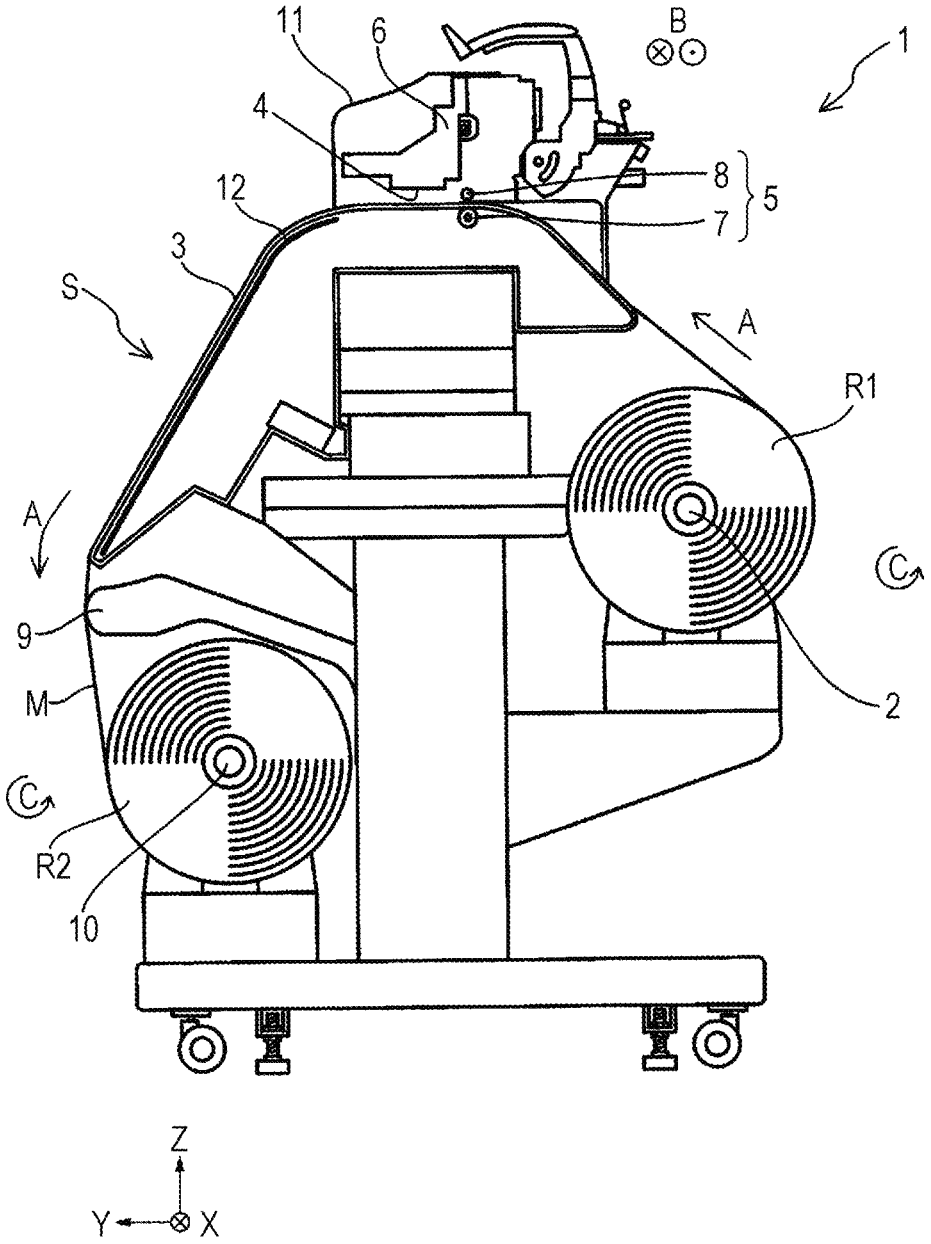
FIG. 1 is a schematic side view of a printing apparatus according to an embodiment of the invention.

FIG. 1 is a schematic side view of the printing apparatus according to the embodiment of the invention.

The printing apparatus 1 according to this embodiment includes a support shaft 2 that supports a roll R1 of a medium M for printing, formed into a roll. In the printing apparatus 1 according to this embodiment, the support shaft 2 rotates in a rotating direction C, when the medium M is transported in a transport direction A. In this embodiment, the medium M is rolled such that the printing surface is oriented outward. However, the medium M rolled such that the printing surface is oriented inward can also be used, in which case the support shaft 2 is rotated in the reverse direction to the rotating direction C, to feed the roll R1.

Although the printing apparatus 1 according to this embodiment is configured to use the roll-type medium M, different types of the medium may be employed. For example, a cut-sheet medium may be employed.

The printing apparatus 1 according to this embodiment also includes a transport roller pair 5 composed of a drive roller 7 and a slave roller 8, used to transport the medium M in the transport direction A, along a transport route including a support member 3 that supports the medium M.

In the printing apparatus 1 according to this embodiment, the drive roller 7 is constituted of a single roller oriented in a scanning direction B intersecting the transport direction A of the medium M, and a plurality of the slave rollers 8 are aligned in the scanning direction B, so as to oppose the drive roller 7.

Further, a heater 12, exemplifying the heating unit, for heating the medium M supported by the support member 3 is provided under the support member 3, at a position downstream of the printing unit 4 to be subsequently described, in the transport direction A of the medium M. Although the printing apparatus 1 according to this embodiment thus includes the heater, corresponding to the heating unit, so as to heat the medium M in a heating range S from the side of the support member 3, the printing apparatus 1 may include, for example, an infrared heater located so as to oppose the support member 3.

The printing apparatus 1 according to this embodiment also includes, inside a casing 11, the printing unit 4 configured as an ink jet head that ejects an ink from a plurality of nozzles provided on a nozzle mounting surface, and a carriage 6, having the printing unit 4 mounted thereon and configured to reciprocate in the scanning direction B.

In the printing apparatus 1 according to this embodiment, the transport direction A of the medium M at the position on the support member 3 opposing the printing unit 4 (nozzle mounting surface) corresponds to a Y-direction in FIG. 1, which is a horizontal direction, the scanning direction B of the printing unit 4 corresponds to an X-direction which is a horizontal direction orthogonal to the Y-direction, and the ejecting direction of the ink corresponds to a Z-direction which is a vertical direction (vertically downward).

As described above, the printing unit 4 is configured to eject the ink from the non-illustrated nozzles onto the medium M being transported, so as to print an image, while reciprocating in the scanning direction B intersecting the transport direction A of the medium M. With the printing unit 4 thus configured, the printing apparatus 1 according to this embodiment alternately repeats the action of transporting the medium M by a predetermined length (one path) in the transport direction A, and causing the printing unit 4 to eject the ink while reciprocating in the scanning direction B, with the medium M stopped, to thereby form a desired image on the medium M.

Here, the printing apparatus 1 according to this embodiment is what is known as a serial printer that alternately repeats the transporting of the medium M and the scanning of the printing unit 4, to perform the printing. Instead, the printing apparatus 1 may be what is known as a line printer that employs a line head having nozzles aligned in the width direction of the medium M, to perform the printing while successively transporting the medium M. Further, printing apparatus 1 may be of a different type from the ink jet printer, for example a transfer printer.

Further, a take-up shaft 10, configured to take up the medium M so as to form a roll R2, is provided downstream of the printing unit 4 in the transport direction A of the medium M. Since the medium M is taken up such that the printing surface is oriented outward in this embodiment, the take-up shaft 10 rotates in the rotating direction C to take up the medium M. The medium M can also be taken up such that the printing surface is oriented inward, by rotating the take-up shaft 10 in the reverse direction to the rotating direction C.

In addition, a tension bar 9, oriented so as to contact the medium M along the scanning direction B to apply a desired tension to the medium M, is provided at a position between the downstream end portion of the support member 3 in the transport direction A of the medium M and the take-up shaft 10.

Hereunder, an electrical configuration of the printing apparatus 1 according to this embodiment will be described.

Figure 2:
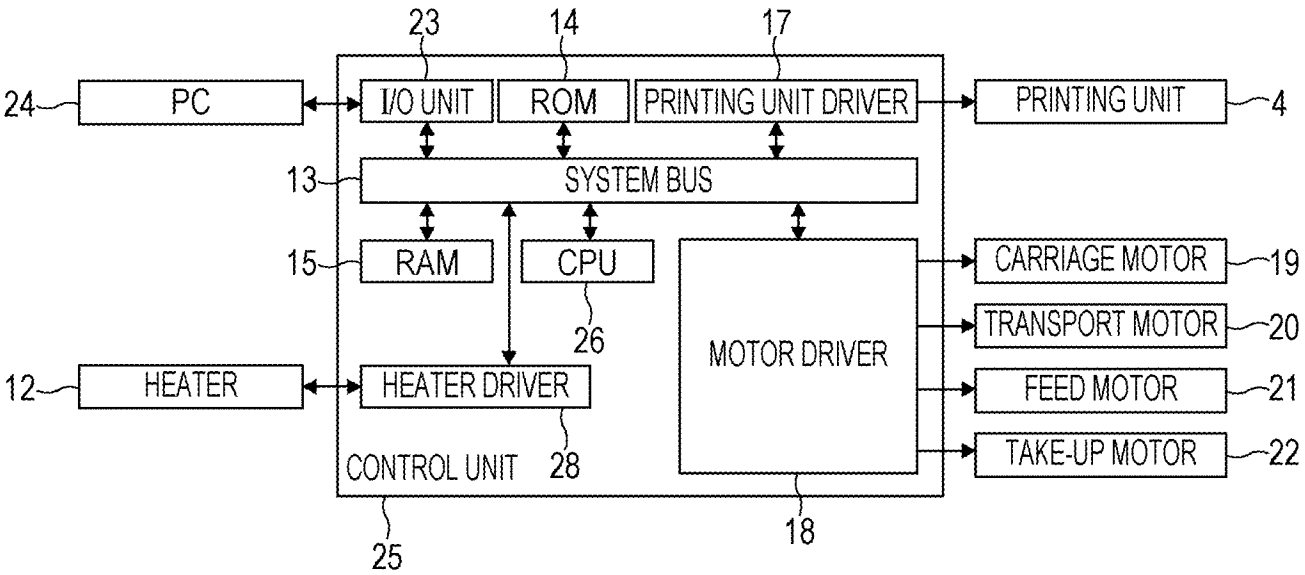
FIG. 2 is a block diagram showing a configuration of the printing apparatus according to the embodiment of the invention.

FIG. 2 is a block diagram showing a configuration of the printing apparatus 1 according to this embodiment.

A control unit 25 includes a CPU 26 that performs overall control of the printing apparatus 1. The CPU 26 is connected, via a system bus 13, to a ROM 14 containing various control programs to be executed by the CPU 26, and a RAM 15 for temporarily storing data.

The CPU 26 is also connected to a printing unit driver 17 for driving the printing unit 4, via the system bus 13.

Further, the CPU 26 is connected, via the system bus 13, to a motor driver 18, which is connected to a carriage motor 19, a transport motor 20, a feed motor 21, and a take-up motor 22.

The carriage motor 19 serves to move the carriage 6 having the printing unit 4 mounted thereon, in the scanning direction B. The transport motor 20 serves to drive the drive roller 7 constituting the transport roller pair 5. The feed motor 21 serves as a rotation mechanism of the support shaft 2, to drive the support shaft 2 so as to feed the medium M toward the transport roller pair 5. The take-up motor 22 serves to drive the take-up shaft 10 to rotate.

The CPU 26 is also connected to a heater driver 28 that drives the heater 12, via the system bus 13.

In addition, the CPU 26 is connected, via the system bus 13, to an input/output (I/O) unit 23 connected to a PC 24 that serves for transmission and reception of data, such as print data, and signals.

With the mentioned configuration, the control unit 25 according to this embodiment is capable of controlling the printing unit 4, the drive roller 7 constituting a part of the transport roller pair serving as a transport unit, and the carriage 6.

Thus, through the control on the printing unit 4, the drive roller 7, and the carriage 6 executed by the control unit 25, the transport of the medium M by a predetermined length (intermittent transport) and the ejection of the ink while moving the printing unit 4 in the scanning direction B can be alternately repeated, so as to perform the printing.

Hereunder, the support member 3, constituting an essential part of the printing apparatus 1 according to this embodiment, will be described.

Figure 3:
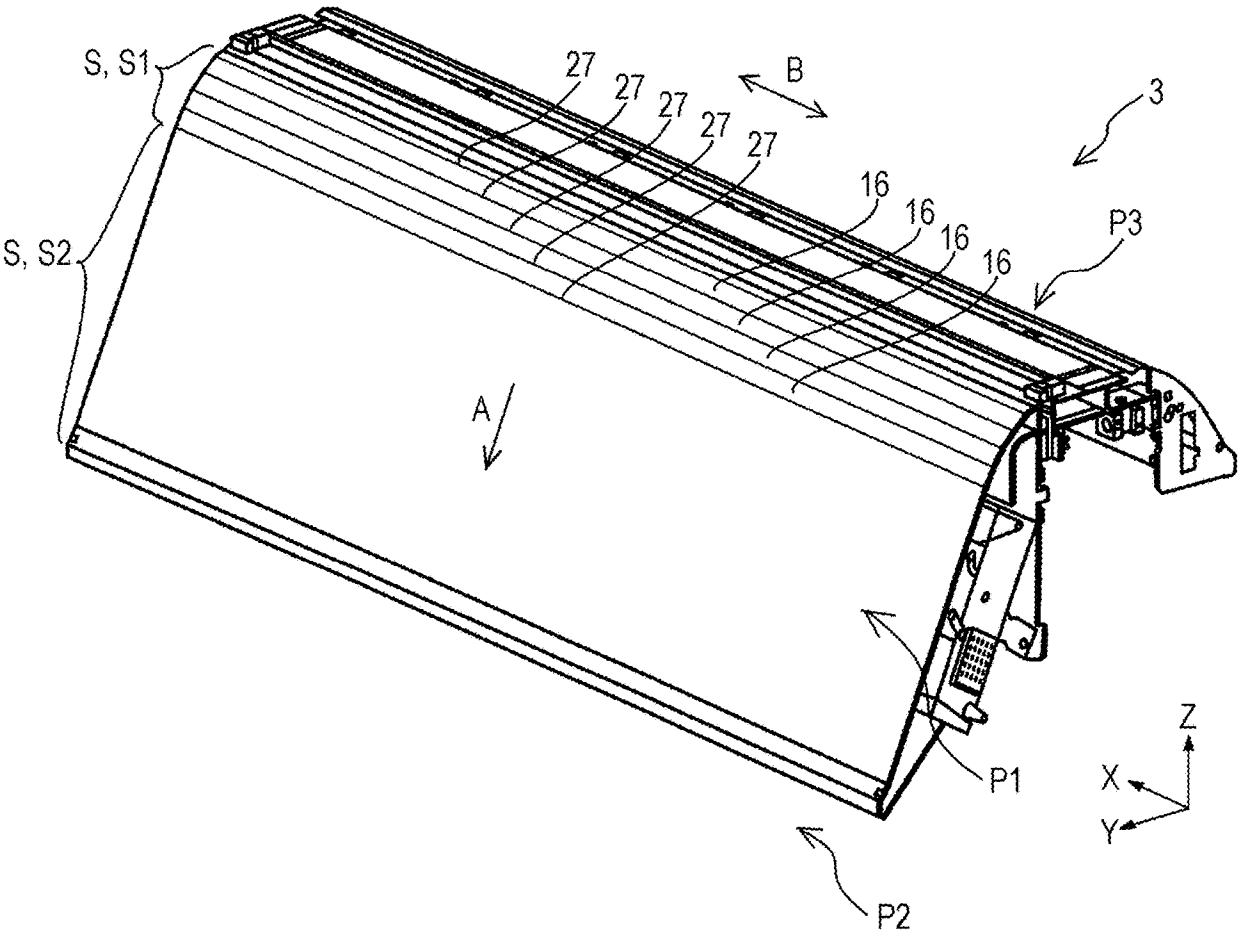
FIG. 3 is a schematic perspective view of an essential part of the printing apparatus according to the embodiment of the invention.
Figure 4:
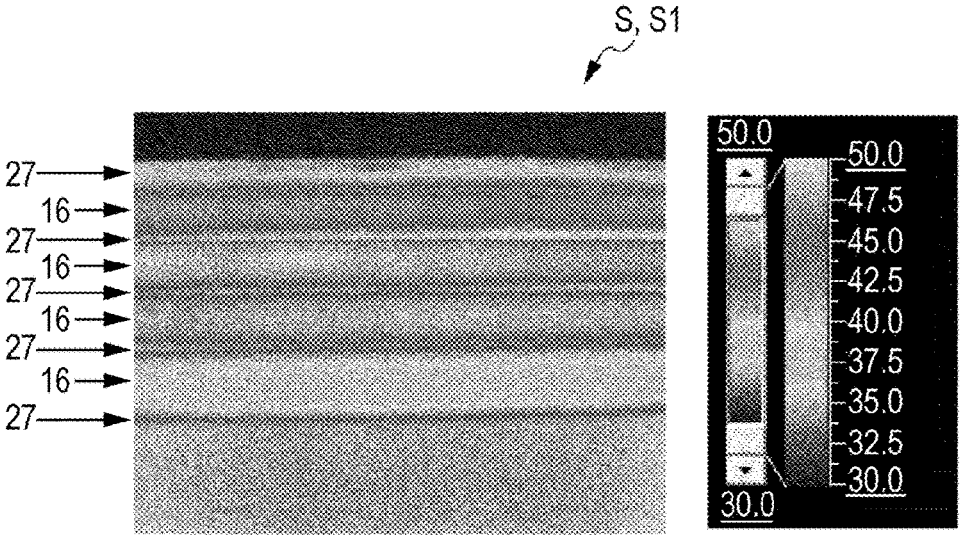
FIG. 4 is a graphic drawing for explaining the essential part of the printing apparatus according to the embodiment of the invention.

FIG. 3 is a schematic perspective view of the support member 3, an essential part of the printing apparatus 1 according to this embodiment. FIG. 4 is a graphic drawing for explaining the support member 3, more specifically a graphic expression of heat distribution in a region S1 where the bent portion 27 is formed, in a heating range S heated by the heater 12 when the power thereto is turned on (surface temperature of the medium M located in the region S1, measured when the transport is stopped for a certain period of time).

As shown in FIG. 3, the support member 3 according to this embodiment includes the heating range S of the heater 12, composed of the region S1 where a plurality of the bent portions 27 are formed so as to bend the support surface for the medium M, and a region S2 corresponding to a flat region of the support surface for the medium M. With the region S1 where the support surface for the medium M is bent, the support member 3 according to this embodiment secures a sufficient area of the heating range S, while reducing the length thereof in the Y-direction. In other words, the printing apparatus 1 according to this embodiment improves the performance of an after heater, without incurring an increase in size of the apparatus.

In this embodiment, the region S1 is formed not by bending the support surface for the medium M in an arcuate (curved) shape, but by forming the plurality of bent portions 27. Forming the region S1 as above facilitates the formation of the bent shape of the support surface for the medium M, with a minimized manufacturing error.

However, forming the region S1 in the support member 3 as in this embodiment incurs a difference in contact status of the medium M and the support surface, between the bent portion 27 and a flat portion 16 (region between adjacent bent portions 27). Referring here to FIG. 4, when the transport of the medium M is stopped for a certain period of time, the surface temperature of the medium M supported in the region S1 becomes different between the portion corresponding to the bent portion 27 and the portion corresponding to the flat portion 16. More specifically, as shown in FIG. 4, the temperature of the portion of the medium M corresponding to bent portion 27 is approximately 50° C., while the temperature of the portion corresponding to the flat portion 16 is approximately 40° C. This is because the medium M is subjected to a greater force exerted from below (force applied to the medium M by the support member 3 because of the medium M being pressed against the support member 3 by the self-weight) at the bent portion 27, than at the flat portion 16. For example, in the region S1 the medium M is supported by the support member 3, only in contact with the bent portion 27, and without contacting the flat portion 16. Therefore, the ink forming the image may dry unevenly when the image formed on the medium M is stopped in the region S1, for a certain period of time after the image is formed, and consequently color unevenness may be incurred.

When the image is located in the region S2, or in a region outside the support member 3 (heating range S), for example a region downstream of the support member 3 in the transport direction A, the ink forming the image dries evenly, and hence the color unevenness is not incurred. However, for example, when the transport of the medium M is stopped for a certain time, with the image located so as to span over the region S1 and the region S2, or located so as to span over the support member 3 and a region outside the support member 3, the ink forming the image may dry unevenly, thus incurring the color unevenness.

In the printing apparatus 1 according to this embodiment, therefore, the control unit 25 restricts the image from being stopped longer than a predetermined time, at a position where the color unevenness is likely to be incurred, to prevent appearance of the color unevenness originating from the uneven drying of the ink.

A specific example of the control performed by the control unit 25, in other words a printing method, will now be described hereunder.

Figure 5:
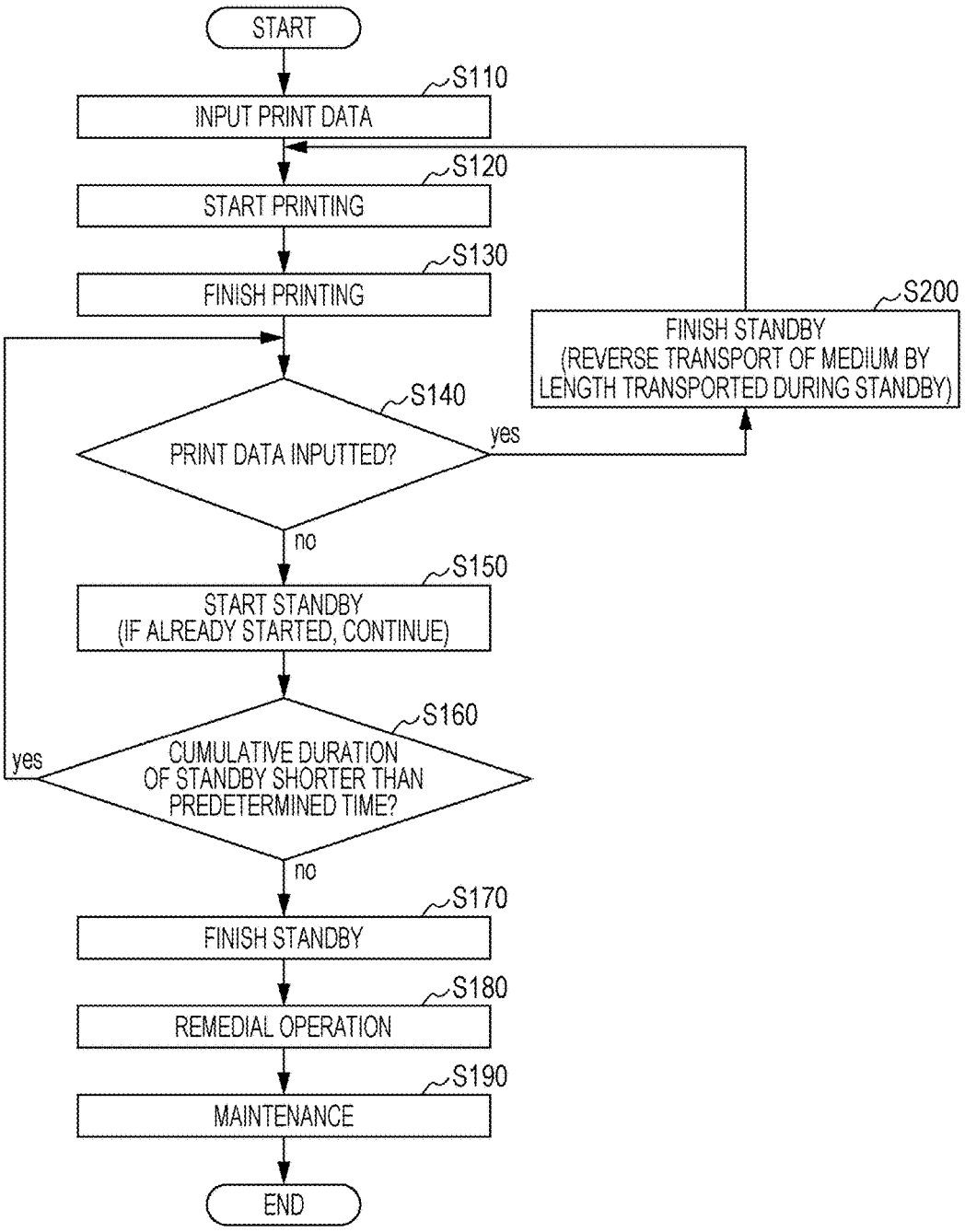
FIG. 5 is a flowchart showing a printing process according to an embodiment of the invention.

FIG. 5 is a flowchart showing an example of the printing method that may be performed by the printing apparatus 1 according to this embodiment.

First, when print data is inputted from the PC24 at step S110, the printing apparatus 1 according to this embodiment starts printing (forming the image) on the basis of the print data, at step S120.

Since the printing apparatus 1 according to this embodiment is configured to perform the printing while intermittently transporting the medium M as described above, the transport condition of the medium M during the printing operation is set to the intermittent transport. However, a line printer may be employed, in which case the medium M may be continuously transported.

When the printing based on the print data is finished at step S130, the control unit 25 decides whether the next print data has been inputted (step S140). In the case where it is decided that the next print data has not been inputted, the control unit 25 starts the standby operation at step S150. Here, before the start of step S150, the image formed on the medium M is located so as to span over the region S1 and the region S2.

The standby operation according to this embodiment includes continuing to transport the medium M, under the same condition as during the printing operation at step S120 (intermittent transport). The standby operation started at step S150 is continued until the operation proceeds to step S170 or step S200 to be subsequently described.

The control unit 25 executes step S160, in parallel with the process of step S150. Although the flowchart shows step S150 and step S160 in series, actually these steps are executed in parallel. At step S160, the control unit 25 decides whether a cumulative duration of the standby operation is shorter than a predetermined time, in other words whether the predetermined time has elapsed. In the case where the cumulative duration of the standby operation is shorter than the predetermined time, the operation returns to step S140, and the control unit 25 again decides whether the next print data has been inputted.

When the next print data is inputted during the standby operation at step S140, the operation is shifted to step S200. At step S200, the standby operation is finished, and the medium M is transported backward, by a length transported during the standby operation. For example, in the case where the standby operation medium M has been transported by a first length in the transport direction A, the medium M is transported in the reverse direction to the transport direction A (reverse transport) by the first length, at step S200. The mentioned arrangement prevents expansion of a blank region in the medium M, when the standby operation is followed by the next printing operation.

Here, step S200 may only include finishing the standby operation, without performing the reverse transport of the medium M. In this case, the next printing operation can be promptly started.

In contrast, in the case where the next print data has not been inputted during the standby operation at step S140, step S160 is again performed, while the standby operation of step S150 is continued. Thus, unless the next print data is inputted within the predetermined time, the operations of step S160 and step S140 are repeated at predetermined intervals, which are shorter than the predetermined time.

When the predetermined time has elapsed without the next print data being inputted, it is decided at step S160 that the cumulative duration of the standby operation is not shorter than the predetermined time, and the operation proceeds to step S170. At step S170, the standby operation is finished. In other words, the transport of the medium M, thus far performed during the standby operation, is stopped.

When the standby operation is finished at step S170, the operation proceeds to step S180 (remedial operation), where the medium M is transported until the image formed on the medium M is located at a predetermined remedial position. In this embodiment, continuous transport is adopted in the remedial operation, however intermittent transport may also be adopted. The predetermined remedial position is one of a plurality of remedial positions prepared in advance, selected by the user. However, the remedial position may be a predetermined position, instead of one selected by the user.

Here, although not included in the flowchart of FIG. 5, in the case where the next print data is inputted after the remedial operation, the user may select whether to start the printing operation after returning the medium M to the position where the medium M was before the standby operation and the remedial operation, or to start the printing operation from the position where the medium M was when the standby operation and the remedial operation were finished. However, instead of allowing the user to select, one of the arrangements may be programmed in advance.

In the case of starting the printing operation after returning the medium M to the position where the medium M was before the standby operation and the remedial operation, the portion of the medium M to be wasted (blank portion) can be reduced.

In contrast, starting the printing operation from the position where the medium M was, when the remedial operation was finished, prevents a portion of the medium M unintendedly heated by the heater 12 during the standby operation, in other words a portion that may have been unevenly heated, from being used for the printing.

In this embodiment, a first remedial position P1, a second remedial position P2, and a third remedial position P3 are prepared, as the remedial position.

In the first remedial position P1, the upstream end of the image formed on the medium M in the transport direction A has passed through the region S1 and is located in the region S2. In this case, the entirety of the image is located inside the region S2, unless the image is longer than the region S2 in the transport direction. Since the bent portion 27 is not provided in the region S2, the image is heated under the same condition, in the region S2. In other words, in the first remedial position P1, the entirety of the image in the heating range S of the heater 12 is heated under the same condition, and therefore uneven heating can be prevented.

In the second remedial position P2, the upstream end of the image formed on the medium M in the transport direction A is located downstream of the support member 3 in the transport direction A. In other words, in the second remedial position P2 the entirety of the image formed on the medium M is located in a position deviated from the support member 3. Thus, the entirety of the image can be deviated from the heating range S of the heater 12 in the second remedial position P2, and therefore uneven heating can be avoided. The second remedial position P2 is particularly advantageous when the image is too large to be located inside the region S2.

In the third remedial position P3, the upstream end of the image formed on the medium M in the transport direction A is located upstream of the heating range S in the transport direction A. More specifically, the upstream end of the image formed on the medium M in the transport direction A is located between the heating range S and the transport roller pair 5. In the third remedial position P3, therefore, although the image is brought back reversely to the transport direction A, the image formed on the medium M is kept from being pinched between the transport roller pair 5. Accordingly, the image can be exempted from collapsing by being pinched between the transport roller pair 5. When the third remedial position P3 is utilized, the portion of the medium M to be wasted (blank portion) can be reduced, even when the next print data is inputted after the remedial operation, and the printing operation is to be started from the position where the medium M was when the remedial operation was finished.

When the remedial operation of step S180 is finished, the control unit 25 proceeds to step S190 to start the maintenance operation.

Here, the maintenance operation according to this embodiment refers, on the assumption that the printing unit 4 is configured to reciprocate in the scanning direction B intersecting the transport direction A, to correcting uneven distribution of grease on the guide shaft, more specifically causing the printing unit 4 to reciprocate over the entire stroke range in the scanning direction B. In this case, the printing unit 4 is made to reciprocate over the entire stroke range in the scanning direction B, without ejecting ink from the nozzles of the printing unit 4. With such an operation, the grease applied to the guide shaft of the printing unit 4 can be distributed all over the guide shaft. However, the type of the maintenance operation is not specifically limited and may also include, for example, detecting skewed transport of the medium M, more specifically transporting the medium M in the forward and reverse directions, thereby detecting whether the ends of the medium M in the width direction are within a predetermined range, and flushing, in other words ejecting the ink from the nozzles for the purpose of discharging residual ink, on the assumption that the printing unit 4 is a liquid ejecting unit.

The conventional printing apparatus is configured to perform the process of step S190 (maintenance operation) with the medium M stopped, without performing the standby operation after step S140. Therefore, the medium M may be unevenly heated during the maintenance operation, and hence the image formed on the medium M may suffer color unevenness. By the printing method according to this embodiment, the maintenance operation is performed after the remedial operation, and therefore the color unevenness of the image originating from the uneven heating of the medium M can be suppressed.

When step S190 is finished, a cycle of the printing method according to this embodiment ends.

In the case where step S140 is performed after the printing operation according to a first print data is finished, the standby operation is not executed.

Accordingly, in the case where YES is selected at step S140 under the mentioned condition, step S200 is skipped, and the operation proceeds to step S120. Such a case takes place, for example, when a first printing instruction and a second printing instruction are successively inputted.

As described above, the printing method according to this embodiment is applicable to the printing apparatus 1 including the printing unit 4 that performs printing on the medium M transported in the transport direction A, the heater 12 located downstream of the printing unit 4 in the transport direction A and configured to heat the medium M, and the control unit 25 that executes the printing operation including printing an image on the medium M according to the printing instruction inputted. The printing method includes, after finishing the printing operation on the medium M according to the Nth (N=an integer not smaller than 1) printing instruction (step S120 to step S130), performing the standby operation (step S150) including waiting for a start of the printing operation on the medium M according to the (N+1)th printing instruction (in the case of YES at step S140), and continuing to transport the medium M during the standby operation.

By the mentioned printing method, the medium M can be prevented from being unevenly heated because of being stopped in the region S1 of the heating range S of the heater 12, during the standby for the start of the printing operation on the medium M according to the (N+1)th printing instruction, after the printing operation on the medium M according to the Nth printing instruction is finished. Therefore, the color unevenness of the image, originating from uneven heating of the medium M, can be prevented.

Here, the expression "continue to transport the medium M" refers to continuing to transport (move) the medium M to restrict the medium M from staying at the same position longer than the predetermined time, including both intermittently transporting the medium M as in this embodiment, and continuously transporting the medium M. Further, continuing to transport the medium M in the transport direction A (forward transport), continuing to transport the medium M in the reverse direction to the transport direction A (reverse transport), and repeating the forward transport and the reverse transport, are also included.

From another viewpoint, the printing apparatus 1 according to this embodiment includes the printing unit 4 that performs printing on the medium M transported in the transport direction A, the heater 12 located downstream of the printing unit 4 in the transport direction A and configured to heat the medium M, and the control unit 25 that executes the printing operation including printing an image on the medium M according to the printing instruction inputted. The control unit 25 is configured to, when the printing operation on the medium M according to the Nth (N=an integer not smaller than 1) printing instruction is finished, and then the standby operation including waiting for the start of the printing operation on the medium M according to the (N+1)th printing instruction is performed, continue to transport the medium M during the standby operation.

With the mentioned configuration, the medium M can be prevented from being unevenly heated because of being stopped in the region S1 of the heating range S of the heater 12, during the standby for the start of the printing operation on the medium M according to the (N+1)th printing instruction, after the printing operation on the medium M according to the Nth printing instruction is finished. Therefore, the color unevenness of the image, originating from uneven heating of the medium M, can be prevented.

As described above, the control unit 25 according to this embodiment continues to transport the medium M (intermittent transport) during the standby operation under a same condition as during the printing operation (intermittent transport). Therefore, the medium M can be prevented from being unevenly heated owing to a change in heating condition between the printing operation and the standby operation, and the color unevenness in the image can be effectively suppressed.

The expression "transport the medium M during the standby operation under the same condition as during the printing operation" herein refers to the case where the transport modes are generally the same, such that simply both are the intermittent transport, or the continuous transport. It is not mandatory that, for example, an interval between feeding actions or a feed stroke per action in the intermittent transport, or transport speed in the continuous transport, is strictly the same.

As described above, further, the printing apparatus 1 according to this embodiment also includes the support member 3 that supports the medium M along the transport route thereof, and the support member 3 includes the bent portion 27 formed in the heating range of the heater 12. Bending the support member 3, in other words forming the bent portion 27 in the support member 3, prevents an increase in size of the printing apparatus 1. Further, forming the bent portion 27 in the support member 3 instead of bending the support member 3 in an arcuate shape, simplifies the formation process of the support member 3 having the bent shape.

As described referring to step S160 to step S180 in FIG. 5, the control unit 25 finishes the standby operation in the case where the (N+1)th printing instruction has not been inputted within the predetermined time, and performs the remedial operation including transporting the medium M until the image printed on the medium M is located in the predetermined remedial position (first remedial position P1, second remedial position P2, or third remedial position P3). Accordingly, setting the remedial position in a location where uneven heating is unlikely to take place prevents the medium M from being unevenly heated, owing to a prolonged time before the next printing instruction is inputted.

Here, "predetermined remedial position" may be any desired position other than the first remedial position P1, the second remedial position P2, and the third remedial position P3.

As described above, further, the control unit 25 according to this embodiment performs the maintenance operation (step S190) including performing a maintenance work for the printing apparatus 1, after the remedial operation (step S180) is finished. Performing thus the maintenance operation after the remedial operation is finished prevents the medium M from being unevenly heated because of remaining in the region S1 in the heating range S of the heater 12 during the maintenance operation. Therefore, the color unevenness in the image, originating from the uneven heating, can be more effectively suppressed.

Still further, the control unit 25 according to this embodiment transports the medium M in the transport direction A during the standby operation, finishes the standby operation when the (N+1)th printing instruction is inputted within the predetermined time, and starts the printing operation on the medium M according to the (N+1)th printing instruction, after transporting the medium M in the reverse direction to the transport direction A. Such an arrangement prevents a portion of the medium M transported during the standby operation from being wasted.

However, the control unit 25 according to this embodiment may also transport the medium M in the transport direction A during the standby operation, finish the standby operation when the (N+1)th printing instruction is inputted within the predetermined time, and start the printing operation on the medium M according to the (N+1)th printing instruction, without transporting the medium M in the reverse direction to the transport direction A. In this case, the next printing operation can be promptly started. In addition, a portion of the medium M unintendedly heated by the heater 12 during the standby operation, in other words a portion of the medium M that may have been unevenly heated, can be prevented from being used for the printing. Therefore, the image can be printed without color unevenness, in the next printing operation.

The invention is not limited to the foregoing embodiments but may be modified in various manners, within the scope of the invention set forth in the appended claims, and it is a matter of course that such modifications are included in the scope of the invention.

This application claims priority under 35 U.S.C. § 119 to Japanese Patent Application No. 2017-018681, filed Feb. 3 2017. The entire disclosure of Japanese Patent Application No. 2017-018681 is hereby incorporated herein by reference.

What is claimed is:

1. A printing apparatus comprising:

a printing unit that performs printing on a medium transported in a transport direction;

a heating unit located downstream of the printing unit in the transport direction and configured to heat the medium; and a control unit that executes a printing operation including printing an image on the medium according to an inputted printing instruction, wherein the control unit is configured to, when the printing operation on the medium according to an Nth (N=an integer not smaller than 1) printing instruction is finished, and then a standby operation including waiting for a start of the printing operation on the medium according to an (N+1)th printing instruction is performed, continue to transport the medium during the standby operation.

2. The printing apparatus according to claim 1, wherein the control unit continues to transport the medium during the standby operation under a same condition as during the printing operation.

3. The printing apparatus according to claim 1, further comprising a support member that supports the medium along a transport route thereof, wherein the support member includes a bent portion located in the heating range of the heating unit.

4. The printing apparatus according to claim 1, wherein the control unit finishes the standby operation in a case where the (N+1)th printing instruction has not been inputted within a predetermined time, and performs a remedial operation including transporting the medium until the image printed on the medium is located in a predetermined remedial position.

5. The printing apparatus according to claim 4, wherein the control unit performs a maintenance operation including performing a maintenance work for the printing apparatus, after the remedial operation is finished.

6. The printing apparatus according to claim 1, wherein the control unit:

transports the medium in the transport direction during the standby operation;

finishes the standby operation when the (N+1)th printing instruction is inputted within the predetermined time; and starts the printing operation on the medium according to the (N+1)th printing instruction, after transporting the medium in a reverse direction to the transport direction.

7. The printing apparatus according to claim 1, wherein the control unit:

transports the medium in the transport direction during the standby operation;

finishes the standby operation when the (N+1)th printing instruction is inputted within the predetermined time; and starts the printing operation on the medium according to the (N+1)th printing instruction, without transporting the medium in a reverse direction to the transport direction.

8. A printing method to be performed by a printing apparatus including a printing unit that performs printing on a medium transported in a transport direction, and a heating unit located downstream of the printing unit in the transport direction and configured to heat the medium, the printing method comprising:

performing a printing operation on the medium with the printing unit;

after performing the printing operation, heating the medium with the heating unit at a position downstream of the printing unit;

after finishing a printing operation on the medium according to an Nth (N=an integer not smaller than 1) printing instruction, performing a standby operation including waiting for a start of the printing operation on the medium according to an (N+1)th printing instruction; and continuing to transport the medium during the standby operation.

9. The printing method according to claim 8, wherein the medium continues to be transported during the standby operation under a same condition as during the printing operation.

10. The printing method according to claim 8, wherein a support member supports the medium during transport, the support member including a bent portion located in the heating range of the heating unit.

11. The printing method according to claim 8, wherein the standby operation is completed in a case where the (N+1)th printing instruction has not been inputted within a predetermined time, and further comprising transporting the medium until the image printed on the medium is located in a predetermined remedial position.

12. The printing method according to claim 11, further comprising performing a maintenance work after the remedial operation is finished.

13. The printing method according to claim 8, further comprising:

finishing the standby operation when the (N+1)th printing instruction is inputted within the predetermined time; and starting the printing operation on the medium according to the (N+1)th printing instruction, after transporting the medium in a reverse direction to the transport direction.

14. The printing method according to claim 8, further comprising:

finishing the standby operation when the (N+1)th printing instruction is inputted within the predetermined time; and starting the printing operation on the medium according to the (N+1)th printing instruction, without transporting the medium in a reverse direction to the transport direction.

* * * * *